US010214884B1

(12) United States Patent
You

(10) Patent No.: US 10,214,884 B1
(45) Date of Patent: Feb. 26, 2019

(54) BASIN FAUCET

(71) Applicant: YOUSHI (XIAMEN) SANITARY WARE INDUSTRIAL CO., LTD., Xiamen (CN)

(72) Inventor: Zhangsen You, Xiamen (CN)

(73) Assignee: YOUSHI (XIAMEN) SANITARY WARE INDUSTRIAL CO., LTD., Xiamen, Fujian (CN)

( * ) Notice: Subject to any disclaimer, the term of this patent is extended or adjusted under 35 U.S.C. 154(b) by 0 days.

(21) Appl. No.: 15/684,924

(22) Filed: Aug. 23, 2017

(51) Int. Cl.
*E03C 1/04* (2006.01)

(52) U.S. Cl.
CPC ..... *E03C 1/0404* (2013.01); *Y10T 137/9464* (2015.04)

(58) Field of Classification Search
CPC ..... Y10T 137/9464; E03C 1/0404
See application file for complete search history.

(56) References Cited

U.S. PATENT DOCUMENTS 5,669,417 A * 9/1997 Lian-Jie ..... E03C 1/0404 137/606
5,924,451 A * 7/1999 Kuo ..... E03C 1/0404 137/606
7,082,966 B2 * 8/2006 Kuo ..... E03C 1/0401 137/801
7,415,991 B2 * 8/2008 Meehan ..... E03C 1/0404 137/801
7,717,133 B2 * 5/2010 Pinette ..... E03C 1/0404 137/801
7,748,409 B2 * 7/2010 Pinette ..... B29C 45/14598 137/801
7,766,043 B2 * 8/2010 Thomas ..... E03C 1/04 137/801
7,794,095 B2 * 9/2010 Gautschi ..... E03C 1/0404 362/318
8,156,963 B2 * 4/2012 Lopp ..... E03C 1/0404 137/625.41
8,185,984 B2 * 5/2012 Meehan ..... E03C 1/0401 137/801
8,430,345 B2 * 4/2013 Esche ..... E03C 1/0404 137/801
8,590,072 B2 * 11/2013 Brunner ..... E03C 1/0404 4/623
8,936,037 B2 * 1/2015 Tan ..... E03C 1/0404 137/15.09

(Continued)

*Primary Examiner* — Reinaldo Sanchez-Medina
*Assistant Examiner* — David Colon Morales
(74) *Attorney, Agent, or Firm* — Leong C. Lei

(57) ABSTRACT

A basin faucet includes a curved faucet made of a metal material and a soft pipe made of a plastic material. The soft pipe is mounted in the curved faucet. One end of the soft pipe is connected with a water outlet connector, and another end of the soft pipe is connected with a water inlet connector. One end of the water inlet connector is fixed to the curved faucet. Another end of the water inlet connector is connected with a water inlet pipe. The water outlet connector is fixed to the curved faucet. At least one of the water inlet connector and the water outlet connector is detachably connected with the soft pipe. The water flows in the soft pipe, not in contact with the curved faucet, and will not cause secondary pollution. The basin faucet provides non-toxic, harmless and green environment-friendly effects.

9 Claims, 3 Drawing Sheets

(56) References Cited

U.S. PATENT DOCUMENTS

| | | | | |
|---|---|---|---|---|
| 9,586,352 | B2 * | 3/2017 | Hua | B29C 45/14778 |
| 2005/0103389 | A1 * | 5/2005 | Wei | E03C 1/0404<br>137/801 |
| 2010/0071778 | A1 * | 3/2010 | Nelson | E03C 1/0404<br>137/15.01 |
| 2011/0167557 | A1 * | 7/2011 | Tan | E03C 1/0404<br>4/675 |
| 2012/0285569 | A1 * | 11/2012 | Wu | E03C 1/04<br>137/801 |
| 2012/0305118 | A1 * | 12/2012 | Itazu | E03C 1/057<br>137/801 |
| 2013/0174932 | A1 * | 7/2013 | Hou | E03C 1/0404<br>138/114 |
| 2014/0015243 | A1 * | 1/2014 | King | E03C 1/021<br>285/8 |

* cited by examiner

BASIN FAUCET

BACKGROUND OF THE INVENTION

1. Field of the Invention

The present invention relates to a faucet, and more particularly to a basin faucet.

2. Description of the Prior Art

These days, there are a variety of faucets made of different materials, such as copper, aluminum alloy, zinc alloy, and the like. When in use, the water passage of the faucet made of a metal material may contain heavy metal elements, such as lead and cadmium, which flow along with the water. The water passage of the faucet is prone to oxidize corrosion to cause secondary pollution of water to endanger human health.

In order to avoid secondary pollution of the faucet, a conventional basin faucet comprises a curved faucet made of a metal material and a soft pipe mounted in the curved faucet. The water flows out from the soft pipe to avoid the water from getting contact with the metal to cause pollution. However, due to the particular shape of the curved faucet, the production process and the structure are complicated. The bending portion of the curved faucet has a thick wall, and the interior of the curved faucet is narrow. Both ends of the soft pipe are integrally connected with respective connectors by welding. The connector is easily jammed when passing through the bending portion of the curved faucet. It is difficult for the soft pipe to pass through the curved faucet. The working efficiency is low. The curved faucet and the soft pipe are easily damaged, resulting in high cost and low yield.

Accordingly, the inventor of the present invention has devoted himself based on his many years of practical experiences to solve these problems.

SUMMARY OF THE INVENTION

The primary object of the present invention is to provide a basin faucet which is safe and environment-friendly without secondary pollution.

In order to achieve the aforesaid object, the basin faucet of the present invention comprises a curved faucet made of a metal material and a soft pipe made of a plastic material. The soft pipe is mounted in the curved faucet. A first end of the soft pipe is connected with a water outlet connector. A second end of the soft pipe is connected with a water inlet connector. One end of the water inlet connector is fixed to the curved faucet. Another end of the water inlet connector is connected with a water inlet pipe. The water outlet connector is fixed to the curved faucet. At least one of the water inlet connector and the water outlet connector is detachably connected with the soft pipe.

Preferably, the water outlet connector includes a fixing connector, an outer sleeve, and a metal retaining ring. The fixing connector is fixedly disposed at the first end of the soft pipe. The outer sleeve has a through hole mated with the fixing connector. An outer wall of the outer sleeve is mated with an inner wall of the metal retaining ring. An outer wall of the metal retaining ring is fixed to a water outlet end of the curved faucet.

Preferably, the water outlet connector further includes a C-shaped snap ring. The fixing connector is provided with a first annular groove. The through hole of the outer sleeve is provided with a step. An inner wall of the C-shaped snap ring is mated with the first annular groove of the fixing connector. An outer wall of the C-shaped snap ring is fitted with the step of the outer sleeve.

Preferably, the inner wall of the metal retaining ring is formed with a second annular groove. The outer wall of the outer sleeve is provided with at least one protrusion. The protrusion is fitted in the second annular groove. Preferably, the metal retaining ring is connected to the curved faucet by welding, screwing or snap-in.

Preferably, the water inlet connector includes a connecting seat fixed to the soft pipe and a mounting seat mated with the connecting seat. A metal mounting ring is fitted on the mounting seat. An outer wall of the metal mounting ring is welded to the curved faucet.

Preferably, a bottom of the connecting seat has a flange. The mounting seat includes a connecting head mated with the connecting seat. The connecting head has a limit step therein to mate with the flange.

Preferably, the connecting seat has a neck. A sealing ring is mated with the neck. The flange of the connecting seat corresponds to the limit step in the connecting head of the mounting seat. The neck is located the limit step and a top of the connecting head. The sealing ring is in tight fit with the connecting head.

Preferably, a bottom of the mounting seat is mated with and fixed to the metal mounting ring. An inner wall of the metal mounting ring is fitted to the bottom of the mounting seat. The mounting seat is provided with an engaging rim. Atop surface of the metal mounting ring leans against the engaging rim. A bottom surface of the metal mounting ring is flush with a bottom surface of the mounting seat. The outer wall of the metal mounting ring is welded to a water inlet end of the curved faucet.

Preferably, an inner wall of the curved faucet is smooth, not angulate.

The basin faucet of the present invention adopts the curved faucet made of a metal material and the soft pipe made of a plastic material, so that the water flows in the soft pipe, not in contact with the curved faucet, and will not cause secondary pollution. The basin faucet provides non-toxic, harmless and green environment-friendly effects.

DETAILED DESCRIPTION OF THE PREFERRED EMBODIMENTS

Embodiments of the present invention will now be described, by way of example only, with reference to the accompanying drawings.

Figure 1:
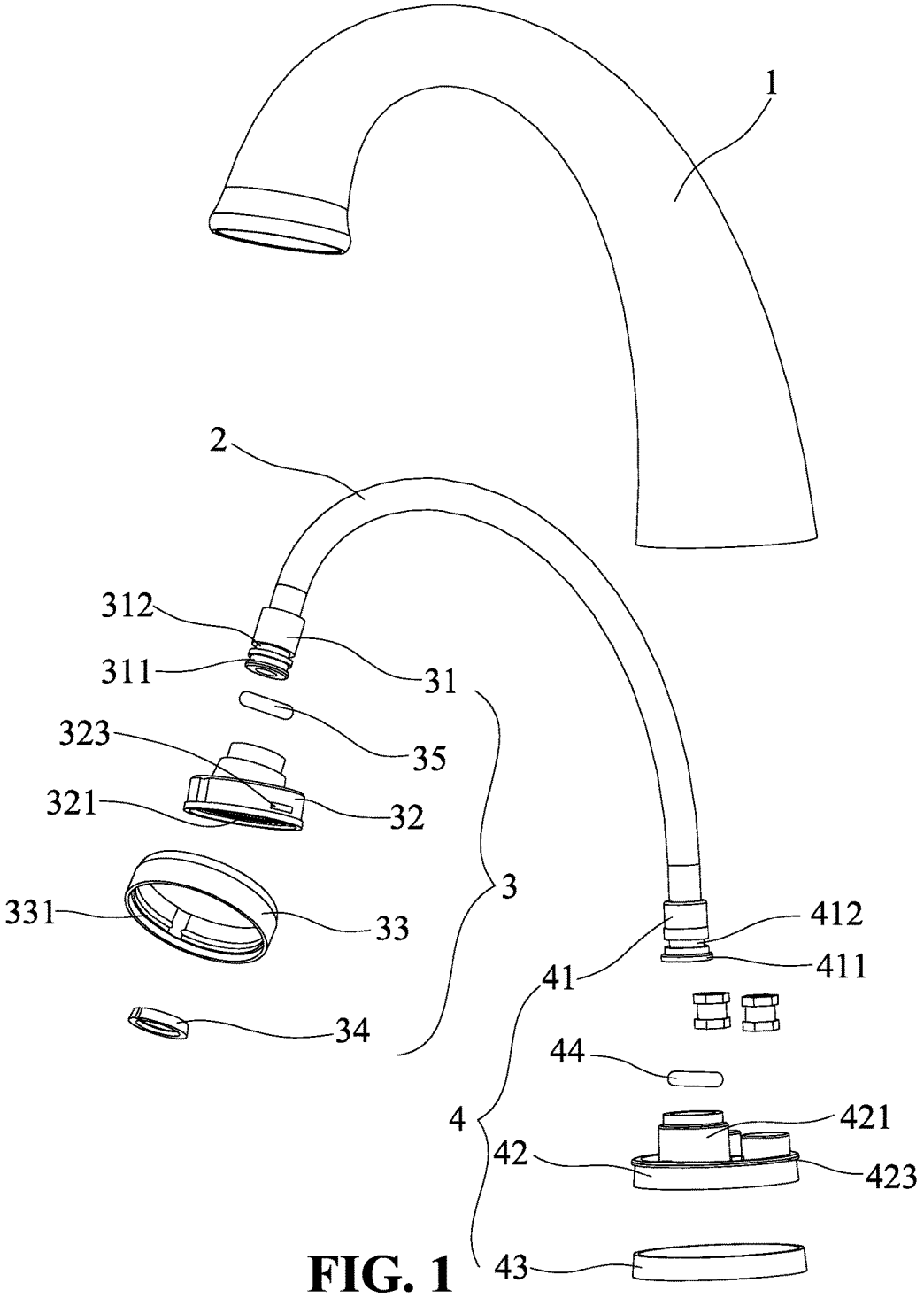
FIG. 1 is an exploded view of the present invention.
Figure 2:
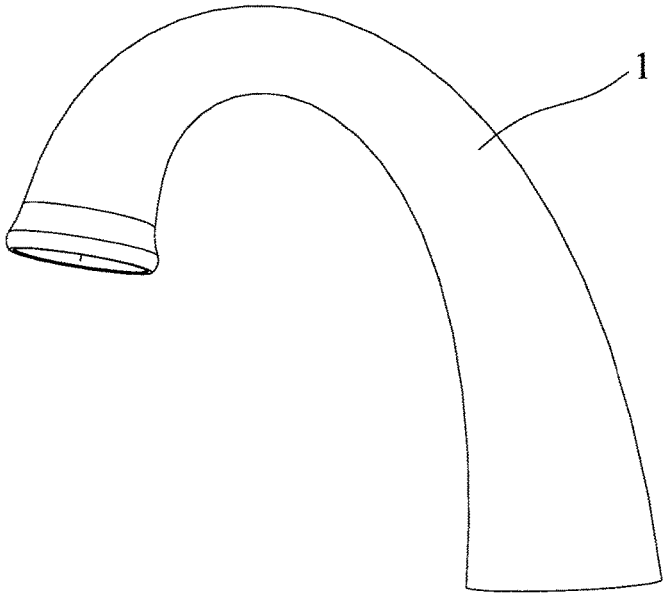
FIG. 2 is a perspective view of the present invention.
Figure 3:
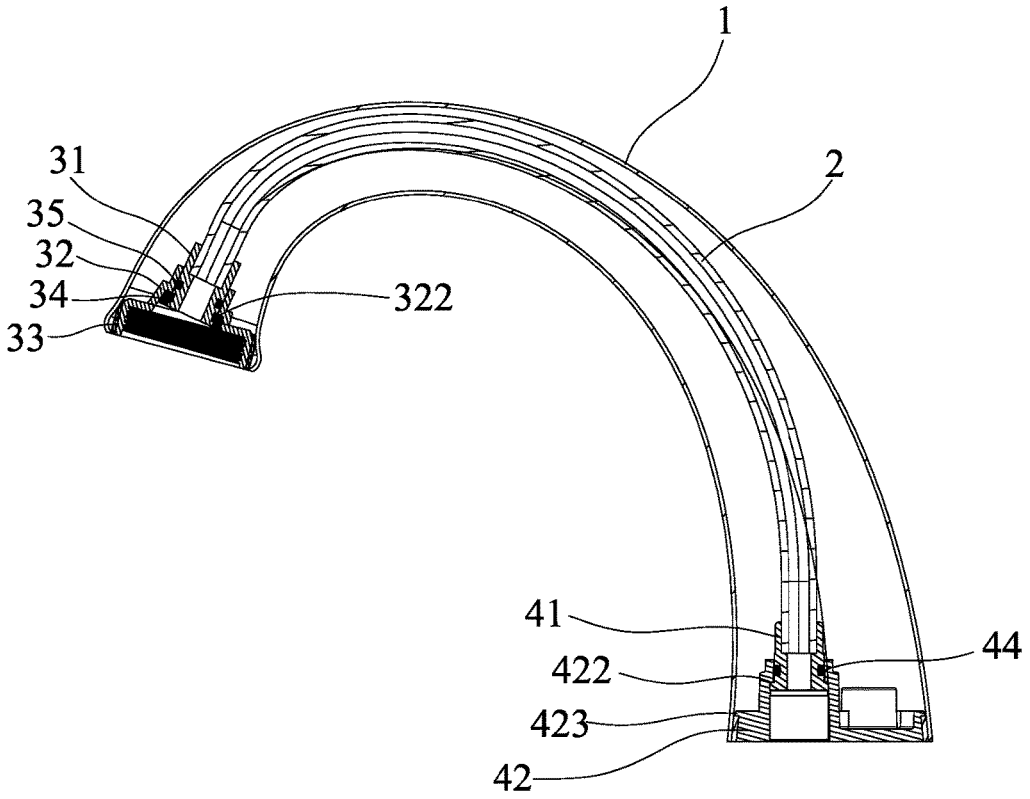
FIG. 3 is a sectional view of the present invention.

As shown in FIG. 1 to FIG. 3, the present invention discloses a basin faucet. The basin faucet comprises a curved faucet 1 made of a metal material and a soft pipe 2 made of a plastic material. The soft pipe 2 is mounted in the curved faucet 1. A first end of the soft pipe 2 is connected with a water outlet connector 3, and a second end of the soft pipe 2 is connected with a water inlet connector 4. One end of the water inlet connector 4 is fixed to the curved faucet 1, and another end of the water inlet connector 4 is connected with a water inlet pipe (not shown). The water outlet connector 3 may be mounted with a faucet aerator. At least one of the water inlet connector 4 and the water outlet connector 3 is detachably connected with the soft pipe 2.

The water outlet connector 3 includes a fixing connector 31, an outer sleeve 32, a metal retaining ring 33 and a C-shaped snap ring 34. The fixing connector 31 is fixedly disposed at the first end of the soft pipe 2. The outer sleeve 32 has a through hole 321 mated with the fixing connector 31. The outer wall of the outer sleeve 32 is mated with the inner wall of the metal retaining ring 33. The outer wall of the metal retaining ring 33 is fixed to a water outlet end of the curved faucet 1. The fixing connector 31 is provided with a first annular groove 311. The through hole 321 of the outer sleeve 32 is provided with a step 322. The inner wall of the C-shaped snap ring 34 is mated with the first annular groove 311 of the fixing connector 31. The outer wall of the C-shaped snap ring 34 is fitted with the step 322 of the outer sleeve 32. The inner wall of the metal retaining ring 33 is formed with a second annular groove 331. The outer wall of the outer sleeve 32 is provided with at least one protrusion 323. The protrusion 323 is fitted in the second annular groove 331. The fixing connector 31 has a neck 312. A sealing ring 35 is mated with the neck 312. The metal retaining ring 33 is connected to the curved faucet 1 by welding, screwing or snap-in.

The water inlet connector 4 includes a connecting seat 41 fixed to the soft pipe 2 and a mounting seat 42 mated with the connecting seat 41. A metal mounting ring 43 is fitted on the mounting seat 42. The outer wall of the metal mounting ring 43 is welded to the curved faucet 1. The bottom of the connecting seat 41 has a flange 411. The mounting seat 42 includes a connecting head 421 mated with the connecting seat 41. The connecting head 421 has a limit step 422 therein to mate with the flange 411. The connecting seat 41 has a neck 412. A sealing ring 44 is mated with the neck 412. The flange 411 of the connecting seat 41 corresponds to the limit step 422 in the connecting head 421 of the mounting seat 42. The neck 412 is located the limit step 422 and the top of the connecting head 421. The sealing ring 44 is in tight fit with the connecting head 421. The bottom of the mounting seat 42 is mated with and fixed to the metal mounting ring 43. The inner wall of the metal mounting ring 43 is fitted to the bottom of the mounting seat 42. The mounting seat 42 is provided with an engaging rim 423. The top surface of the metal mounting ring 43 leans against the engaging rim 423. The bottom surface of the metal mounting ring 43 is flush with the bottom surface of the mounting seat 42. The outer wall of the metal mounting ring 43 is welded to a water inlet end of the curved faucet 1.

When assembled, one of the water inlet connector 4 and the water outlet connector 3 is integrally formed with the soft pipe 2 during the molding of the soft pipe 2, and the other is detachably connected with the soft pipe 2. Both the water inlet connector 4 and the water outlet connector 3 may be detachably connected with the soft pipe 2, respectively. In order to facilitate the assembly, the inner wall of the curved faucet 1 is smooth, not angulate, which is convenient for insertion of the soft pipe 2. The water inlet connector 4 of the soft pipe 2 is fitted with the water inlet end of the curved faucet 1 by welding. The water inlet connector 4 is first formed by injection molding, and then the metal mounting ring 43 of the water inlet connector 4 is welded to the curved faucet 1. Because the water inlet connector 4 is connected with the water inlet pipe, the water pressure will impact the water inlet connector 4 and the curved faucet 1. If the water inlet connector 4 and the soft pipe 2 are connected together by screwing or snap-in, the strength is not enough, which may cause water leakage and pollution.

The basin faucet of the present invention adopts the curved faucet 1 made of a metal material and the soft pipe 2 made of a plastic material, so that the water flows in the soft pipe 2, not in contact with the curved faucet 1, and will not cause secondary pollution. The basin faucet provides non-toxic, harmless and green environment-friendly effects.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A basin faucet, comprising a curved faucet made of a metal material and a soft pipe made of a plastic material, the soft pipe being mounted in the curved faucet, a first end of the soft pipe being connected with a water outlet connector, a second end of the soft pipe being connected with a water inlet connector, one end of the water inlet connector being fixed to the curved faucet, the water outlet connector being fixed to the curved faucet, at least one of the water inlet connector and the water outlet connector being detachably connected with the soft pipe; wherein the water inlet connector includes a connecting seat fixed to the soft pipe and a mounting seat mated with the connecting seat, a metal mounting ring is fitted on the mounting seat, and an outer wall of the metal mounting ring is welded to the curved faucet.

2. The basin faucet as claimed in claim 1, wherein the water outlet connector includes a fixing connector, an outer sleeve, and a metal retaining ring, the fixing connector is fixedly disposed at the first end of the soft pipe, the outer sleeve has a through hole mated with the fixing connector, an outer wall of the outer sleeve is mated with an inner wall of the metal retaining ring, and an outer wall of the metal retaining ring is fixed to a water outlet end of the curved faucet.

3. The basin faucet as claimed in claim 2, wherein the water outlet connector further includes a C-shaped snap ring, the fixing connector is provided with a first annular groove, the through hole of the outer sleeve is provided with a step, an inner wall of the C-shaped snap ring is mated with the first annular groove of the fixing connector, and an outer wall of the C-shaped snap ring is fitted with the step of the outer sleeve.

4. The basin faucet as claimed in claim 2, wherein the inner wall of the metal retaining ring is formed with a second annular groove, the outer wall of the outer sleeve is provided with at least one protrusion, and the protrusion is fitted in the second annular groove.

5. The basin faucet as claimed in claim 2, wherein the metal retaining ring is connected to the curved faucet by welding, screwing or snap-in.

6. The basin faucet as claimed in claim 1, wherein a bottom of the connecting seat has a flange, the mounting seat includes a connecting head mated with the connecting seat, and the connecting head has a limit step therein to mate with the flange.

7. The basin faucet as claimed in claim 6, wherein the connecting seat has a neck, a sealing ring is mated with the neck, the flange of the connecting seat corresponds to the limit step in the connecting head of the mounting seat, the neck is located the limit step and a top of the connecting head, and the sealing ring is in tight fit with the connecting head.

8. The basin faucet as claimed in claim 1, wherein a bottom of the mounting seat is mated with and fixed to the metal mounting ring, an inner wall of the metal mounting ring is fitted to the bottom of the mounting seat, the mounting seat is provided with an engaging rim, a top surface of the metal mounting ring leans against the engaging rim, a bottom surface of the metal mounting ring is flush with a bottom surface of the mounting seat, and the outer wall of the metal mounting ring is welded to a water inlet end of the curved faucet.

9. The basin faucet as claimed in claim 1, wherein an inner wall of the curved faucet is smooth, not angulate.

* * * * *